US006084488A

United States Patent [19]

Macbeth et al.

[11] Patent Number: 6,084,488

[45] **Date of Patent: *Jul. 4, 2000**

[54] COMPACT HIGH CURRENT RELAY

[75] Inventors: Bruce F. Macbeth, Syracuse; James K. Findley, Manlius; Michael R. Bryndzia, Baldwinsville, all of N.Y.

[73] Assignee: Pass & Seymour, Inc., Solvay, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/054,656

[22] Filed: Apr. 3, 1998

[51] Int. Cl.[7] ..... H01H 67/02

[52] U.S. Cl. ..... 335/132; 335/83

[58] Field of Search ..... 335/132, 209, 335/220, 250, 251, 255, 270, 278, 78–83

[56] References Cited

U.S. PATENT DOCUMENTS

| | | | |
|---|---|---|---|
| 3,210,616 | 10/1965 | Severn | 335/220 |
| 4,216,452 | 8/1980 | Arnoux et al. . | |
| 4,525,694 | 6/1985 | Dennison et al. | 335/132 |
| 4,594,484 | 6/1986 | Lemmer | 335/132 |
| 4,620,172 | 10/1986 | Rudolf . | |
| 4,710,740 | 12/1987 | Dennison | 335/248 |
| 4,882,558 | 11/1989 | Takayanagi | 335/260 |
| 4,956,624 | 9/1990 | Streich et al. | 335/132 |
| 4,982,060 | 1/1991 | Streich et al. | 200/243 |
| 5,206,617 | 4/1993 | Bolz | 335/132 |
| 5,635,886 | 6/1997 | Pichard | 335/132 |

*Primary Examiner*—Lincoln Donovan

*Attorney, Agent, or Firm*—Harter, Secrest & Emery LLP; Stephen B. Salai, Esq.; Brian B. Shaw, Esq.

[57] ABSTRACT

A compact high current relay is provided having first and second fixed contacts connected in circuit relationship with the apparatus to be controlled; an elongated bus bar having first and second movable contacts at opposite ends of the bus bar, the bus bar characterized by a stiffness such that upon application of a first predetermined force to the bus bar, between the contacts, the movable contacts both tilt and wipe with respect to the first and second fixed contacts; and a solenoid connected to the bus bar between the first and second contacts for exerting a force on the bus bar greater than the predetermined force.

18 Claims, 3 Drawing Sheets

COMPACT HIGH CURRENT RELAY

FIELD OF INVENTION

This invention relates generally to electromechanical relays and more particularly to a compact high current relay, particularly suited for use in electrical wiring devices, such as portable ground fault circuit interrupters, electrical receptacles including circuit interrupters of the ground fault or arc fault of other types, and other applications where small size and high current carrying capacity are required.

BACKGROUND OF INVENTION

Electromechanical relays of the type with which this invention is concerned include one or more pairs of movable contacts that can be selectively brought into engagement to complete an electrical circuit, or moved apart to open the circuit. When the relay contacts are either brought together or moved apart, and a potential difference exists across the contacts, arcing occurs. A variety of techniques have been employed in the past to minimize the amount of arcing, and/or compensate for the arcing, to provide a relay that continues to operate effectively.

When an arc occurs, it is common for material to be transferred from one relay contact to another, and in many cases, an actual weld, albeit a small one, is formed between the contacts. In normally open relays, for example, if a weld is formed between contacts when the contacts are closed, the weld may tend to hold the contacts closed when operating forces are removed, and this may prevent the relay from opening as desired. Typically, electromechanical relays include a solenoid for physically pulling the contacts together, and rely on a spring to force the contacts open when the solenoid is de-energized.

It is common to arrange relay contacts so that they engage and/or separate with a combination of relative movements, including opening and closing movements generally perpendicular to the surfaces of the contacts, and wiping movements generally transverse to the surfaces. The relative wiping movement of the contacts reduces the tendency for arcing to create welds during opening or closing, and therefore makes the relay more reliable.

Another requirement for electromechanical relays is that they provide a sufficient air gap to allow the relay to withstand the desired operating voltage when the contacts are open. While arbitrarily large single air gaps can be provided, it has been noted that larger effective air gaps can be created in a relay by utilizing a pair of fixed contacts in combination with a bus bar. As used herein, we refer to fixed contacts and movable contacts, but it is to be understood that all that is required is that one set of contacts be movable relative to the other. It may be that either or both of the contacts is actually movable or fixed, as circumstances require.

An electrical circuit to be controlled by the relay is connected to the fixed contacts. A pair of movable contacts is attached to a bus bar that is arranged to place the movable contacts into engagement with fixed contacts or to move in the opposite direction to disconnect movable contacts from the fixed contacts. The gaps between the fixed and movable contacts in a bus bar arrangement are in series, and therefore a given gap is effectively doubled in a bus bar arrangement, thus providing a more compact high voltage relay, compared with one having the entire air gap in a single pair of contacts.

Heretofore, in relays using a bus bar arrangement, substantially rigid, that is inflexible, bus bars have been employed to carry the movable contacts. The bus bar has typically been cantilevered at the end of an arm controlled by a solenoid to move the bus bar into engagement with the fixed contacts, to close the circuit. Wiping has been provided in a direction transverse to the major axis of the bus bar, that is the axis lying along a line extending between contacts. While this arrangement is effective, it is physically large and there is a need for a more compact construction.

It is an object of this invention to provide a compact high current relay that overcomes some of the problems associated with relays heretofore known.

It is another object of this invention to provide a compact high current relay having a bus bar carrying movable contacts that is sufficiently flexible to allow wiping at the contacts as the contacts are closed, without the need for complex mechanical arrangements.

SUMMARY OF INVENTION

Briefly stated, and in accordance with a presently preferred embodiment of this invention, a compact high current relay is provided having first and second fixed contacts connected in circuit relationship with the apparatus to be controlled; an elongated bus bar having first and second movable contacts at opposite ends of the bus bar, the bus bar characterized by a stiffness such that upon application of a first predetermined force to the bus bar, between the contacts, the movable contacts both tilt and wipe with respect to the first and second fixed contacts; and a solenoid connected to the bus bar between the first and second contacts for exerting a force on the bus bar greater than the predetermined force.

BRIEF DESCRIPTION OF THE DRAWINGS

The novel aspects of this invention are set forth with particularity in the appended claims. The invention itself, together with further objects and advantages thereof, may be more readily comprehended by reference to the following detailed description of a presently preferred embodiment of the invention taken in conjunction with the accompanying drawings in which:

DETAILED DESCRIPTION OF A PREFERRED EMBODIMENT OF THE INVENTION

Figure 1:
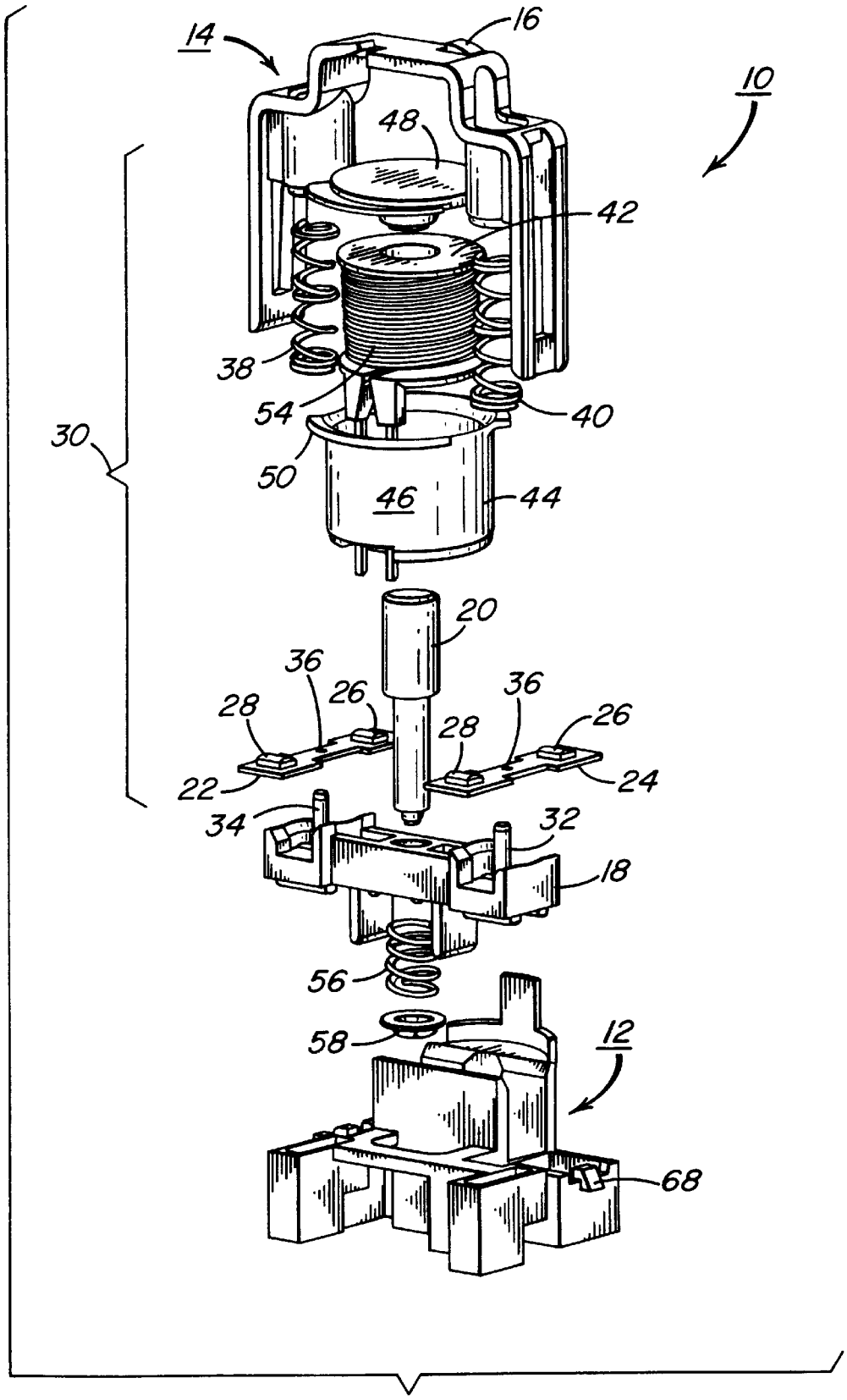
FIG. 1 is a diagrammatic view of a compact high current relay in accordance with the invention.
Figure 3:
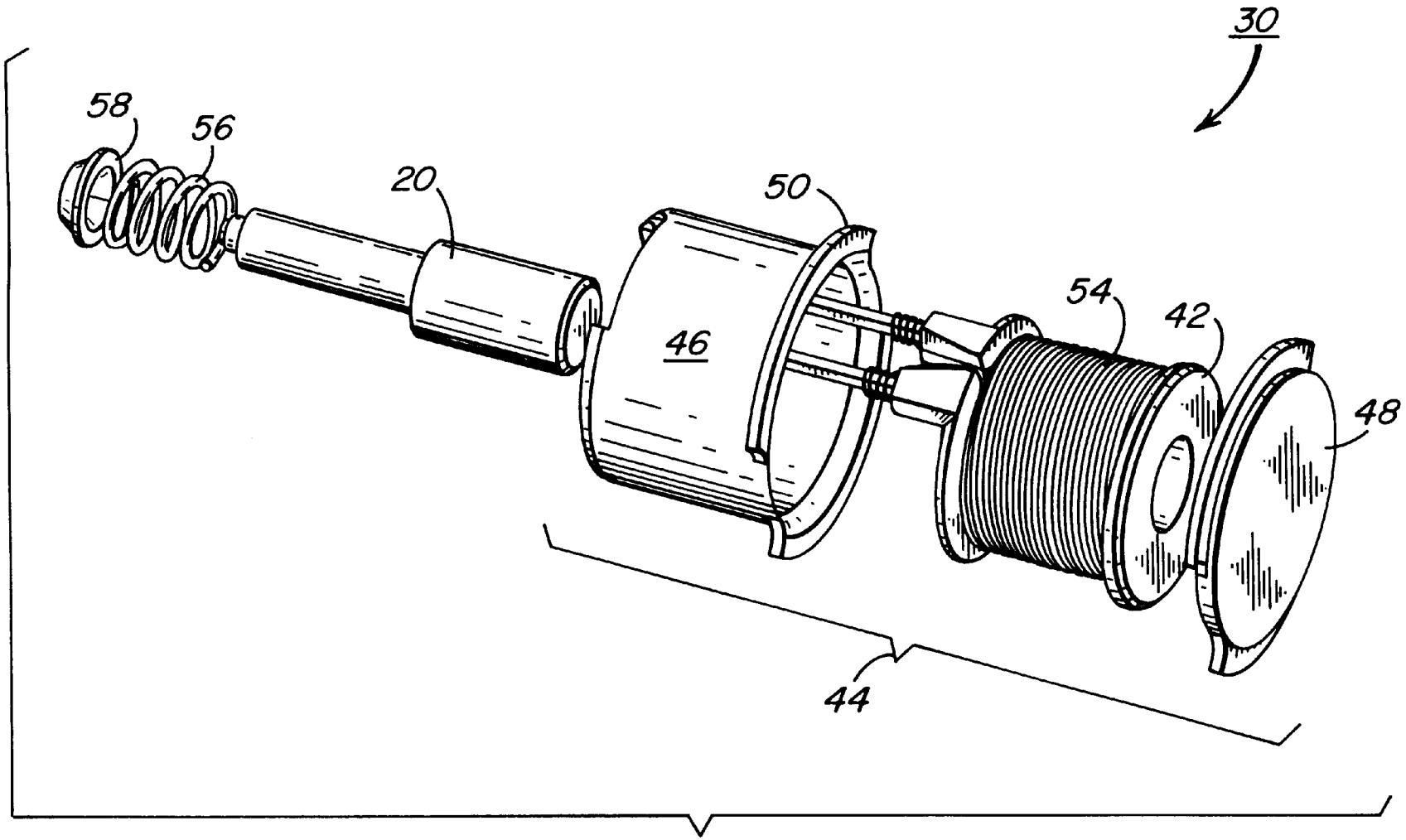
FIG. 3 is an exploded view of the solenoid.

Referring now to FIG. 1 and FIG. 3, a compact high current relay designated generally at 10 is arranged to be mounted on a wiring board, such as a printed circuit wiring board that includes other elements of an electrical circuit, such as a ground fault or arc fault circuit interrupter, or other circuit in which a relay is required. Relay 10 includes an upper, preferably plastic flexible frame element 14 having at least one compression contact 16. A solenoid 30 is mounted in the frame element 14. The construction of the solenoid 30 will be described in more detail later. A movable actuator bar 18 is slidably mounted in the base 12 for reciprocal movement. Preferably, the actuator bar is connected to the plunger via a retainer 58. A solenoid plunger 20 has one end connected to the actuator bar 18 and another end received within the solenoid. Upon actuation of the solenoid 30, the solenoid plunger 20 is drawn into the solenoid, thereby raising the actuator bar 18.

First and second bus bars, 22 and 24 respectively, are connected to first and second ends respectively, of the actuator bar 18, so that when the solenoid plunger 20 is drawn up into the solenoid 30, the bus bars 22 and 24 are raised. Each bus bar 22, 24 includes a first contact 26 and a second contact 28 at opposite ends of the bus bar 22 and 24. Preferably, the bus bars 22, 24 are mounted on the actuator bar 18 by first and second projections 32, 34 respectively extending upwardly from the actuator bar 18, as shown in FIG. 1, which projections engage an opening 36 in the center of each bus bar 22, 24. Alternatively, the bus bars may frictionally engage the actuactor bar. Thus, when the solenoid 30 is actuated and the plunger 20 raises, the actuator bar 18 exerts an upward force at the center of each bus bar 22, 24.

Not shown in this drawing are first and second pairs of fixed contacts arranged above the movable contacts on the bus bars, so that when the actuator bar is raised, the movable contacts engage the fixed contact to form a complete electrical circuit.

First and second springs 38, 40 extend between the upper frame element 14 and the actuator bar 18 for holding the contacts in a normally open position. The upper frame element 14 preferably snaps into the base 12 using biased detents 68. When the solenoid 30 is actuated, the magnetic force generated by the coil 54 on the plunger 20 overcomes the force of the springs 38, 40 and 56 to close the contacts.

As shown in FIG. 3, the solenoid 30 comprises a coil 54, a bobbin 42, a keeper 44, and a plunger 20. The solenoid coil 54 is preferably formed from a spool of wire wound around a bobbin 42 encased within a keeper 44. The solenoid coil 54 used in the relay of this invention is particularly well suited to provide the large force required to assure that adequate wiping takes place in the relay of this invention. The force created by the solenoid coil 54 is increased by a special keeper 44 that substantially completely surrounds the coil 54, except for a small opening through which the plunger 20 and the bobbin electrical contact extends. The keeper 44 includes a cup shaped lower housing 46 and an upper housing plate 48. In order to decrease the magnetic losses at the joint between the lower housing and the upper housing plate, the lower cup shaped housing 46 is provided with a radially extending flange 50 and the upper housing plate 48 is large enough to form a magnetic coupling ring with the flange 50. The coupling provided between the upper and lower housings is adequate, so that preferably no mechanical fastening, such as screws or rivets, is required, thereby reducing the cost both of fabricating and assembling the relay of this invention. However, alternative means of attachment may include screws, pop rivets, welding or other metallurgical processes.

The keeper 44 is preferably formed from material having a relatively high magnetic permeability, thereby to increase the flux generated by the coil and the force generated by the solenoid.

The upstanding posts 32 and 34 on the actuator bar 18 form locating pins both for the bus bars and for the return springs of the relay.

Figure 2:
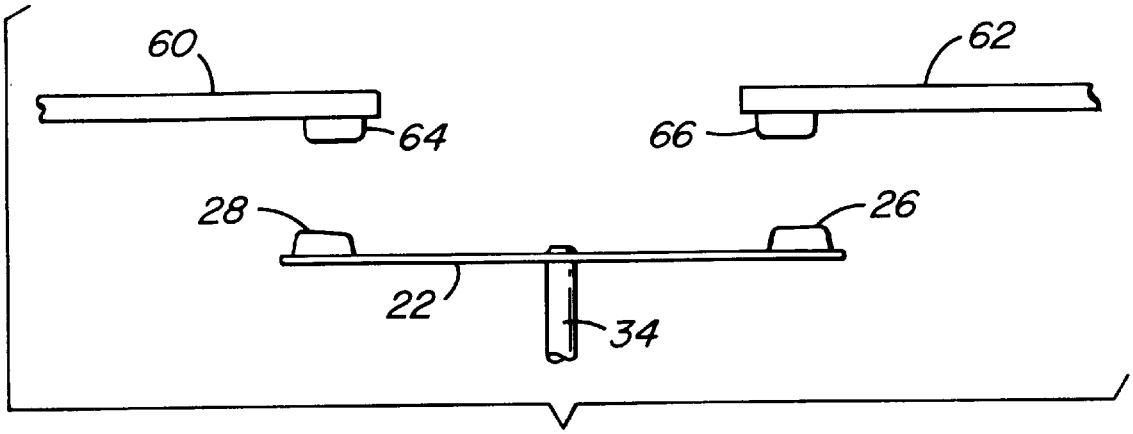
FIGS. 2 and 2*a* are a diagrammatic view of one set of contacts of the relay of FIG. 1, showing the manner in which the contacts tilt and wipe to reduce the effects of arcing during operation.

FIG. 2 shows the relationship between the fixed and movable contacts of the relay of FIG. 1. The fixed contacts 64, 66 are mounted on first and second substantially rigid supports 60, 62 for both forming electrical contacts with the contacts, and mechanically supporting them. In accordance with this invention, the fixed contacts 64, 66 are arranged above the movable contacts 26, 28, but the reverse arrangement may also be employed.

Figure 2A:
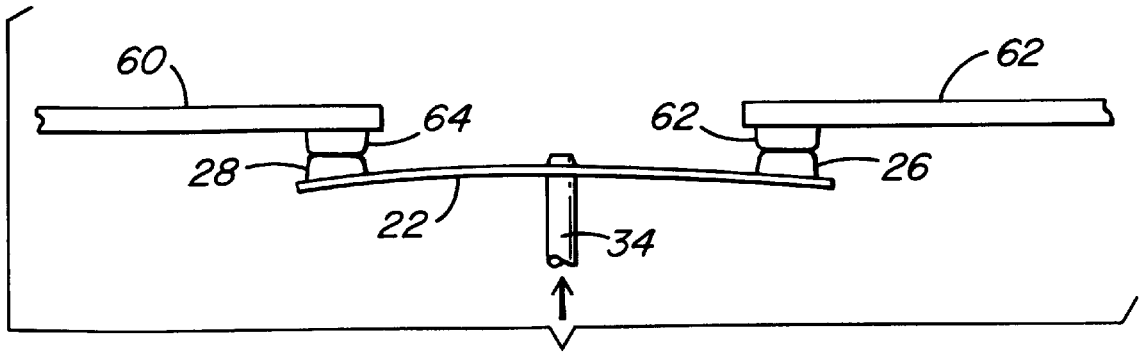

The movable contacts 26, 28 are located at opposite ends of an elongated bus bar 22 which are preferably centered on pin 34 of the actuator bar 18(not shown in FIGS. 2, 2*a*; see FIG. 1). The bus bar 22 is constructed from a material such as brass, bronze, or steel that has both relatively low electrical resistance and enough flexibility so that when the contacts close, the bus bar 22 flexes as shown in FIG. 2*a*. Preferably, the bus bar 22 flexes without significantly stretching, and therefore the movable contacts 26, 28 both tilt and wipe with respect to the fixed contacts 64, 66, thereby minimizing the formation of welds between the contacts either on contact opening or contact closure.

While the invention has been described in connection with a presently preferred embodiment thereof, those skilled in the art will recognize that certain modifications and changes may be made without departing from the true spirit and scope of the invention, which accordingly is intended to be defined solely by the appended claims.

What is claimed is:

1. A relay comprising first and second fixed contacts;

elongated bus bar leaving first and second removable contacts at opposing ends of the bus bar;

actuator bar supporting the elongated bus bar; and solenoid coupled to the actuator bar for moving the movable contacts into contact with the fixed contacts and flexing the elongated bus bar so that the first and second movable contacts both tilt and wipe with respect to the first and second fixed contacts.

2. The relay of claim 1 in which the bus bar flexes along a line extending between the movable contacts so that the movable contacts tilt in opposite directions.

3. The relay of claim 1 in which the bus bar flexes along a line between the movable contacts so that the movable contacts wipe in opposite direction.

4. The relay of claim 1 further comprising two of the elongated bus bars, the two elongated bus bars mounted on opposite ends of an actuator bar.

5. The relay of claim 4 in which the solenoid is mounted between the two elongated bus bars.

6. The relay of claim 5 comprising an upper housing frame member substantially surrounding the solenoid.

7. The relay of claim 6 in which the solenoid comprises a lower magnetic permeable cup-shaped housing and an upper plate-shaped housing for forming a closed magnetic circuit.

8. The relay of claim 7 in which the lower housing comprises a magnetic coupling flange attached to a top edge thereof, and the upper housing overlaps the flange for forming and annular magnetic coupling ring between the cup-shaped element and the plate.

9. The relay of claim 1 in which the bus bar comprises brass, bronze or steel.

10. The relay of claim 6 in which the upper housing frame is plastic.

11. The relay of claim 6 in which the upper housing frame is flexible.

12. The relay of claim 1 further comprising a base.

13. The relay of claim 12, the actuator bar being slideably mounted in the base.

14. The relay of claim 1 wherein the two bus bars extend perpendicular to a major length of the actuator bar.

15. The relay of claim 14 wherein the actuator bar engages the bus bar.

16. The relay of claim 15 wherein the actuator bar comprises first and second upstanding posts on opposing ends of the actuator bar along its major length.

17. The relay of claim 16 wherein the bus bars rest directly on the first and second upstanding posts.

18. A relay comprising first and second faxed contacts; first and second elongated bus bars, each bus bar having first and second moveable contacts at opposing ends of the bus bars;

an actuator bar comprising first and second upstanding posts on opposing ends of the actuator bar along its major length, the first and second upstanding posts engaging the first and second bus bars, respectively; and a solenoid coupled to the actuator bar for moving the moveable contacts into contact with the fixed contacts and flexing the elongated bus bars so that the first and second moveable contacts of each bus bar both tilt and wipe with respect to the first and second fixed contacts.

* * * * *

UNITED STATES PATENT AND TRADEMARK OFFICE

CERTIFICATE OF CORRECTION

PATENT NO. : 6,084,488
DATED : July 4, 2000
INVENTOR(S) : Bruce F. Macbeth, et al.

It is certified that error appears in the above—identified patent and that said Letters Patent is hereby corrected as shown below:

CLAIMS

Claim 1, Column 4, Line 22, please delete the word "leaving" and insert -having-.

Claim 18, Column 5, Line 3, please delete the word "faxed" and insert -fixed-.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*